US006530640B1

(12) United States Patent
Vega et al.

(10) Patent No.: US 6,530,640 B1
(45) Date of Patent: Mar. 11, 2003

(54) FOCUSED INK DROP DETECTION

(75) Inventors: Ramon Vega, Barcelona (ES); Marc Serra, Barcelona (ES); Xavier Bruch, Barcelona (ES)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/940,435

(22) Filed: Aug. 29, 2001

(51) Int. Cl.[7] ..... B41J 29/393
(52) U.S. Cl. ..... 347/19
(58) Field of Search ..... 347/19, 23, 81

(56) References Cited

U.S. PATENT DOCUMENTS

| | | | | | |
|---|---|---|---|---|---|
| 4,509,057 | A | * | 4/1985 | Sohl et al. | 347/19 |
| 4,835,435 | A | | 5/1989 | Yeung et al. | 310/324 |
| 5,276,970 | A | | 1/1994 | Wilcox et al. | 33/18.1 |
| 5,614,930 | A | | 3/1997 | Osborne et al. | 347/33 |
| 5,867,184 | A | | 2/1999 | Quintana | 347/29 |
| 6,086,190 | A | | 7/2000 | Schantz et al. | 347/81 |
| 6,130,682 | A | * | 10/2000 | Kohno et al. | 347/19 |
| 6,238,112 | B1 | | 5/2001 | Girones et al. | 400/74 |
| 6,273,542 | B1 | * | 8/2001 | Couwenhoven et al. | 347/19 |

FOREIGN PATENT DOCUMENTS

| | | | | |
|---|---|---|---|---|
| EP | 1 033 251 A1 | * | 6/2000 | B41J/2/165 |
| EP | 1 084 847 A2 | * | 3/2001 | B41J/2/165 |

* cited by examiner

*Primary Examiner*—Judy Nguyen
*Assistant Examiner*—Blaise Mouttet

(57) ABSTRACT

The amount of time required to perform ink drop detections may be substantially reduced by characterizing which nozzles stand a greater likelihood of failure and by performing drop detections more frequently on those nozzles as compared to nozzles that have been identified as having less of a risk of failure. Continuous drop detection on those nozzles that have been identified as standing less of a risk of failure may be substantially omitted, without negatively impacting the quality of a printed output in a substantial manner. By selectively performing drop detections on those nozzles that stand a greater likelihood of failure, it may be possible to both reduce the amount of time required to test the nozzles as well as substantially any negative impact on print quality caused by these nozzles. The characterization of the nozzles as standing a greater likelihood of failure may be based upon the selected printmode. In addition, the determination of which nozzles to perform drop detection upon may also be based upon the selected printmode. In this respect, the throughput and the print quality may be adjusted according to user preferences.

30 Claims, 5 Drawing Sheets

FOCUSED INK DROP DETECTION

FIELD OF THE INVENTION

This invention relates generally to inkjet printers. More specifically, the present invention relates to focused ink drop detection of inkjet printer nozzles.

BACKGROUND OF THE INVENTION

Inkjet printing mechanisms, e.g., printers, photocopiers, facsimile machines, etc., typically implement inkjet cartridges, often called "pens" to shoot drops of ink onto a sheet of print media, e.g., paper, fabric, textile, and the like. Some inkjet printing mechanisms carry an ink cartridge with an entire supply of the ink back-and-forth across the sheet. Other inkjet print mechanisms, known as "off-axis" systems, propel only a small ink supply with the printhead carriage across the print zone, and store the main ink supply in a stationary reservoir, which is located off-axis from the path of the printhead travel. Typically, a flexible conduit or tubing is used to convey the ink from the off-axis reservoir to the printhead cartridge.

Pens typically have a printhead that includes very small nozzles on an orifice plate through which the ink drops are fired. The particular ink ejection mechanism within the printhead may take on a variety of different forms as known to those skilled in the art, such as those using piezoelectric or thermal inkjet technology. To print an image, the printhead is scanned back-and-forth across a print zone above the sheet, with the pen shooting drops of ink as it moves. By selectively firing ink through the nozzles of the printhead, the ink is expelled in a pattern on the print media to form a desired image (e.g., picture, chart, text and, like). The nozzles are typically arranged in one or more linear arrays along the printhead. If more than one, the two linear arrays are typically located side-by-side on the printhead, parallel to one another, and substantially perpendicular to the scanning direction. Thus, the length of the nozzle arrays defines a print swath or band. That is, if all the nozzles of one array were continually fired as the print head made one complete traverse through the print zone, a band or swath of the ink would appear on the sheet. The height of this band is known as the "swath height" of the pen, the maximum pattern of ink which can be laid down in a single pass.

The orifice plate of the printhead has a tendency to pick up contaminants, such as paper dust, and the like, during the printing process. Such contaminants may adhere to the orifice plate either because of the presence of ink on the printhead, or because of electrostatic charges. In addition, excess dried ink can accumulate around the printhead. The accumulation of either ink or other contaminants can impair the quality of the output by interfering with the proper application of ink to the print media. In addition, if color pens are used, each printhead may have different nozzles which each expel different colors. If ink accumulates on the orifice plate, mixing of different colored inks (cross-contamination) can result during use which may lead to adverse affects on the quality of the resulting printed product. Furthermore, the nozzles may become clogged, particularly if the printheads are left uncapped for a relatively long period of time. For at least these reasons, it is desirable to clear the printhead orifice plate of such contaminants on a substantially routine basis.

In this respect, servicing operations are typically performed on the nozzles prior to, during, and after completion of the performance of a printing operation. To accomplish the servicing operations, inkjet printing mechanisms typically possess a service station located along the scanning direction to perform a plurality of servicing operations on the nozzles, e.g., collecting spit ink, capping the nozzles, and wiping the orifice plate.

The manner and form of the servicing operations are typically controlled by a servicing protocol that uses a drop detector to determine whether any of the nozzles are operating in an improper manner, e.g., nozzle outs, paper crashes, and the like. As an example, a servicing operation may be triggered when the drop detector determines that a nozzle in a printhead is clogged or otherwise improperly ejecting ink. The servicing protocol may control the printheads of a printer mechanism to travel over the drop detector at certain times before, during and after performance of a printing operation. Typically, once the printheads are maneuvered over the drop detector, each of the nozzles contained in each of the printheads is tested. Although this type of complete nozzle testing is typically beneficial to the quality of the printed output, the amount of time required to perform the ink drop detections on all of the nozzles (e.g., known printheads may include two rows of 524 nozzles) typically negatively impacts throughput, i.e., amount of time required to print a plot.

SUMMARY OF THE INVENTION

In accordance with one aspect, the present invention relates to a method of focused ink drop detection. In the method, a first drop detection is performed on a plurality of nozzles. Each of the nozzles is characterized into at least one of a plurality of groups, based upon the results of the first drop detection. In addition, each of the groups corresponds to a predetermined nozzle condition. The categorization of each of the nozzles is stored in a memory. Further, a second drop detection is performed on a first group of nozzles. In addition, the characterization of the nozzles may be predicated upon the available historical data of each of the nozzles obtained during previous drop detections.

In accordance with another aspect, the present invention pertains to an apparatus for operating a printing mechanism having at least one printhead, in which each of the printheads has a plurality of nozzles. The apparatus includes a controller operable to control the plurality of nozzles to fire a set of ink drops into a drop detector. The drop detector is configured to determine a characteristic of the ink drops fired from each of the nozzles to thereby determine a condition of each of the nozzles. The apparatus also includes a memory configured to store the conditions of the nozzles, in which the nozzles are characterized and stored in terms of their conditions, and in which the nozzles are grouped in terms of their conditions. The controller is further operable to a control at least one group of the nozzles to fire another set of ink drops into the drop detector.

According to yet another aspect, the present invention relates to a computer readable storage medium on which is embedded one or more computer programs. The one or more computer programs implement a method for operating a printing mechanism having a printhead, in which the printhead has a plurality of nozzles. The one or more computer programs include a set of instructions for performing a first drop detection on the plurality of nozzles. The one or more computer programs also include a set of instructions for categorizing each of the nozzles into at least one of a plurality of groups, based upon the results of said first drop detection, in which each of the groups correspond to a predetermined nozzle condition. The one or more computer programs further includes a set of instructions for storing the categorization of each of the nozzles in a memory and performing a second drop detection on a first group of nozzles.

In comparison to known printing mechanisms and techniques, certain embodiments of the invention are capable of achieving certain aspects, including some or all of the following: (1) time savings in performance of ink drop detections; (2) ink savings during performance of ink drop detections; (3) substantial optimization of the ink drop detection process; (4) substantial conformance of the ink drop detection operations based upon user preferences. Those skilled in the art will appreciate these and other benefits of various embodiments of the invention upon reading the following detailed description of a preferred embodiment with reference to the belowlisted drawings.

BRIEF DESCRIPTION OF THE DRAWINGS

Features and advantages of the present invention will become apparent to those skilled in the art from the following description with reference to the drawings, in which.

DETAILED DESCRIPTION OF THE INVENTION

For simplicity and illustrative purposes, the principles of the present invention are described by referring mainly to an exemplary embodiment thereof. In the following description, numerous specific details are set forth in order to provide a thorough understanding of the present invention. It will be apparent however, to one of ordinary skill in the art, that the present invention may be practiced without limitation to these specific details. In other instances, well known methods and structure have not been described in detail so as not to unnecessarily obscure the present invention.

According to the principles of the present invention, the amount of time required to perform drop detections may be substantially reduced by characterizing which nozzles stand a greater likelihood of failure and by performing drop detections more frequently on those nozzles as compared to nozzles that have been identified as standing less of a risk of failure. It has been found that nozzles determined to be in relatively good operating condition tend to remain in relatively good operating condition, barring any relatively detrimental occurrences befalling the nozzles, e.g., paper crashes,jams, etc. It is therefore possible to forego continuous drop detection on those nozzles as a matter of routine, without negatively impacting the quality of a printed output in a substantial manner. Instead, by performing drop detection on those nozzles that stand a greater likelihood of failure, it may be determined when they fail and a printing mask may be created to substantially hide those nozzles. Thus, by selectively performing a greater number of and/or more frequent drop detections on those nozzles that stand a greater likelihood of failure, it may be possible to both reduce the amount of time required to test the nozzles as well as substantially any negative impact on print quality caused by operation of those nozzles.

In one respect, the characterization of the nozzles as standing a greater likelihood of failure may be based upon the selected printmode. Thus, a predetermined threshold of timing of drop detection performance may be associated with the selected printmode, e.g., draft, print, or the like. In addition, the determination of which nozzles to perform drop detection upon may also be based upon the selected printmode. In this respect, the throughput and the print quality may be adjusted according to user preferences.

Figure 1:
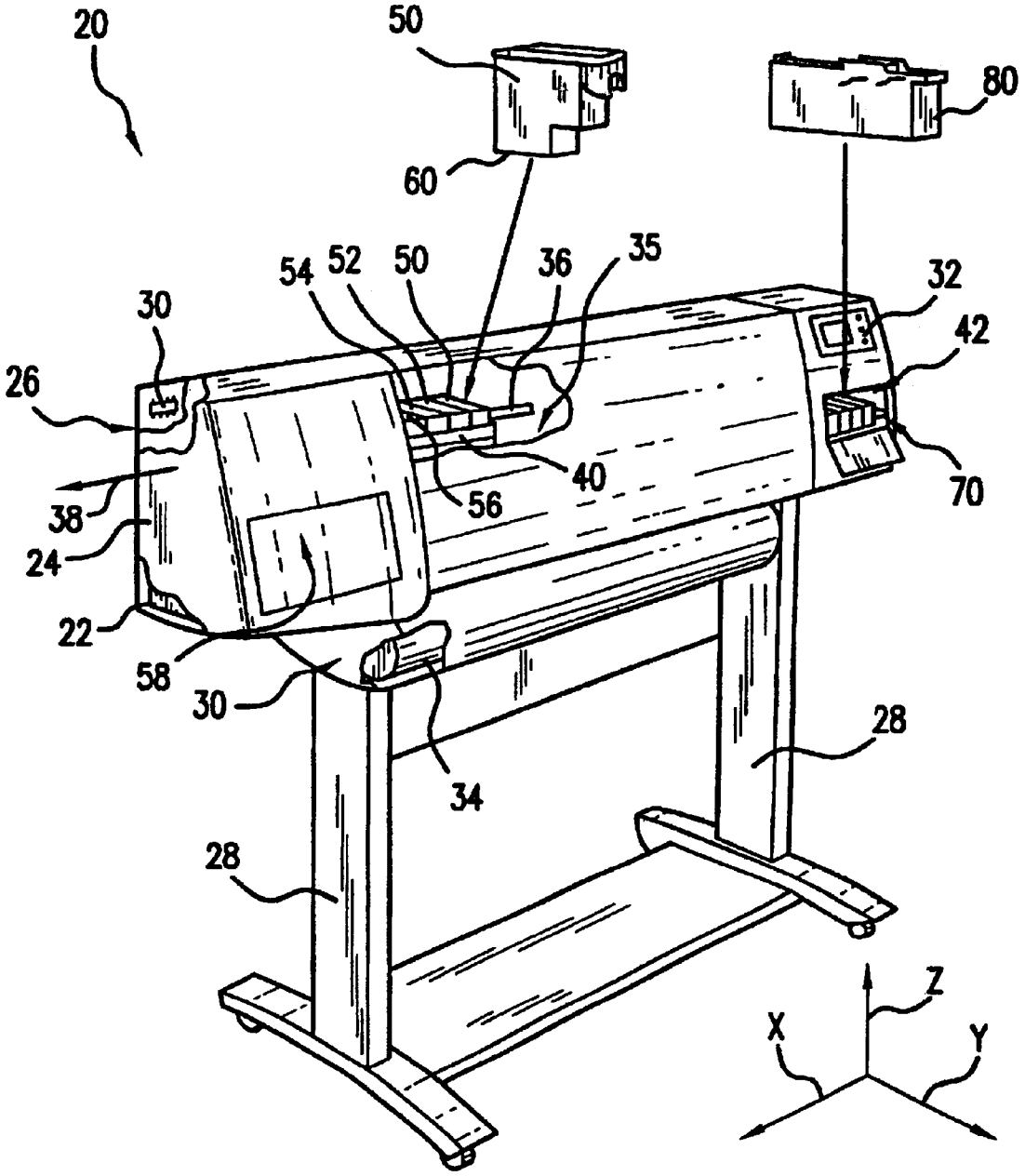
FIG. 1 is a perspective view of one form of an inkjet printing mechanism, here an inkjet printer.

FIG. 1 illustrates an embodiment of a printer 20 constructed in accordance with the principles of the present invention, which may be used for recording information onto a recording medium, such as, paper, textiles, and the like, in an industrial, office, home or other environment. The present invention may be practiced in a variety of printers. For instance, it is contemplated, although not limited to, that an embodiment of the present invention may be practiced in large scale textile printers, desk top printers, portable printing units, copiers, cameras, video printers, and facsimile machines, to name a few. For convenience, the concepts of the present invention are illustrated in the environment of a printer 20.

While it is apparent that the printer components may vary from model to model, the printer 20 includes a chassis 22 surrounded by a housing or casing enclosure 24, typically of a plastic material, together forming a print assembly portion 26 of the printer 20. While it is apparent that the print assembly portion 26 may be supported by a desk or tabletop, it is preferred to support the print assembly portion 26 with a pair of leg assemblies 28. The printer 20 also has a printer controller 30, illustrated schematically as a microprocessor, that receives instructions from a host device, typically a computer, such as a personal computer or a computer aided drafting (CAD) computer system (not shown). A manner in which the controller 30 operates will be described in greater detail hereinbelow.

The printer controller 30 may also operate in response to user inputs provided through a key pad and status display portion 32, located on the exterior of the casing 24. A monitor coupled to the host device may also be used to display visual information to an operator, such as the printer status or a particular program being run on the host device. Personal and drafting computers, their input devices, such as a keyboard and/or a mouse device, and monitors are all well known to those skilled in the art.

A conventional recording media handling system (not shown) may be used to advance a continuous sheet of recording media 34 from a roll through a printzone 35. The recording media may be any type of suitable sheet material, such as paper, poster board, fabric, transparencies, mylar, and the like. A carriage guide rod 36 is mounted to the chassis 22 to define a scanning axis 38, with the guide rod 36 slideably supporting a carriage 40 for travel back and forth, reciprocally, across the printzone 35. A conventional carriage drive motor (not shown) may be used to propel the carriage 40 in response to a control signal received from the controller 30. To provide carriage positional feedback information to controller 30, a conventional metallic encoder strip (not shown) may extend along the length of the printzone 35 and over a servicing region 42. A conventional optical encoder reader may be mounted on the back surface of carriage 40 to read positional information provided by the encoder strip, for example, as described in U.S. Pat. No. 5,276,970, also assigned to Hewlett-Packard Company, the assignee of the present invention. The manner of providing positional feedback information via the encoder strip reader, may also be accomplished in a variety of ways known to those skilled in the art.

Upon completion of printing an image, the carriage 40 may be used to drag a cutting mechanism across the final trailing portion of the media to sever the image from the remainder of the roll 34. Suitable cutter mechanisms are commercially available in DesignJet.RTM. 650C and 750C color printers. Of course, sheet severing may be accomplished in a variety of other ways known to those skilled in the art. Moreover, the illustrated printer 20 may also be used for printing images on pre-cut sheets, rather than on media supplied in a roll 34.

In the printzone 35, the recording medium receives ink from four cartridges 50–56. Although four cartridges 50–56 are illustrated, it is within the purview of the present invention that the printer may contain any reasonably suitable number of cartridges, e.g., two, six, eight, twelve, and the like. For purposes of simplicity and illustration, printer 20 will be described in terms of the four cartridges. Thus, additional cartridges may be implemented in the same or like manner as described hereinbelow with respect to cartridges 50–56. The cartridges 50–56 are also often called "pens" by those in the art. One of the pens, for example pen 50, may be configured to eject black ink onto the recording medium, where the black ink may contain a pigment-based ink. Pens 52–56 may be configured to eject variously colored inks, e.g., yellow, magenta, cyan, light cyan, light magenta, blue, green red, to name a few. For the purposes of illustration, pens 52–56 are described as each containing a dye-based ink of the colors yellow, magenta and cyan, respectively, although it is apparent that the color pens 52–56 may also contain pigment-based inks in some implementations. It is apparent that other types of inks may also be used in the pens 50–56, such as paraffin-based inks, as well as hybrid or composite inks having both dye and pigment characteristics.

The printer 20 uses an "off-axis" ink delivery system, having main stationary reservoirs (not shown) for each ink (black, cyan, magenta, yellow) located in an ink supply region 58. In this respect, the term "off-axis" generally refers to a configuration where the ink supply is separated from the print heads 50–56. In this off-axis system, the pens 50–56 maybe replenished by ink conveyed through a series of flexible tubes (not shown) from the main stationary reservoirs so only a small ink supply is propelled by carriage 40 across the printzone 35 which is located "off-axis" from the path of printhead travel. Some or all of the main stationery reservoirs may be located in a region generally away from the interior of the printer 20. In addition, the number of main stationary reservoirs may vary and is not required to equal the number of cartridges 50–56 utilized in the printer 20. In this respect, the printer 20 may include a lesser or greater number of reservoirs than the number of cartridges 50–56. As used herein, the term "pen" or "cartridge" may also refer to a replaceable printhead cartridge where each pen has a reservoir that carries the entire ink supply as the printhead reciprocates over the printzone.

The illustrated pens 50–56 have printheads 60–66, respectively, which selectively eject ink to form an image on a sheet of media 34 in the printzone 35. These printheads 60–66 have a large print swath, for instance about 20 to 25 millimeters (about one inch) wide or wider, although the concepts described herein may also be applied to smaller-printheads. The printheads 60–66 each have an orifice plate with a plurality of nozzles formed therethrough in a manner well known to those skilled in the art.

The nozzles of each printhead 60–66 are typically formed in at least one, but typically two linear arrays along the orifice plate. Thus, the term "linear" as used herein may be interpreted as "nearly linear" or substantially linear, and may include nozzle arrangements slightly offset from one another, for example, in a zigzag arrangement. Each linear array is typically aligned in a longitudinal direction substantially perpendicular to the scanning axis 38, with the length of each array determining the maximum image swath for a single pass of the printhead. The illustrated printheads 60–66 are thermal inkjet printheads, although other types of printheads may be used, such as piezoelectric printheads. The thermal printheads 60–66 typically include a plurality of resistors which are associated with the nozzles. Upon energizing a selected resistor, a bubble of gas is formed which ejects a droplet of ink from the nozzle and onto a sheet of print medium in the printzone 35 under the nozzle. The printhead resistors are selectively energized in response to firing command signals delivered from the controller 30 to the printhead carriage 40.

Figure 2:
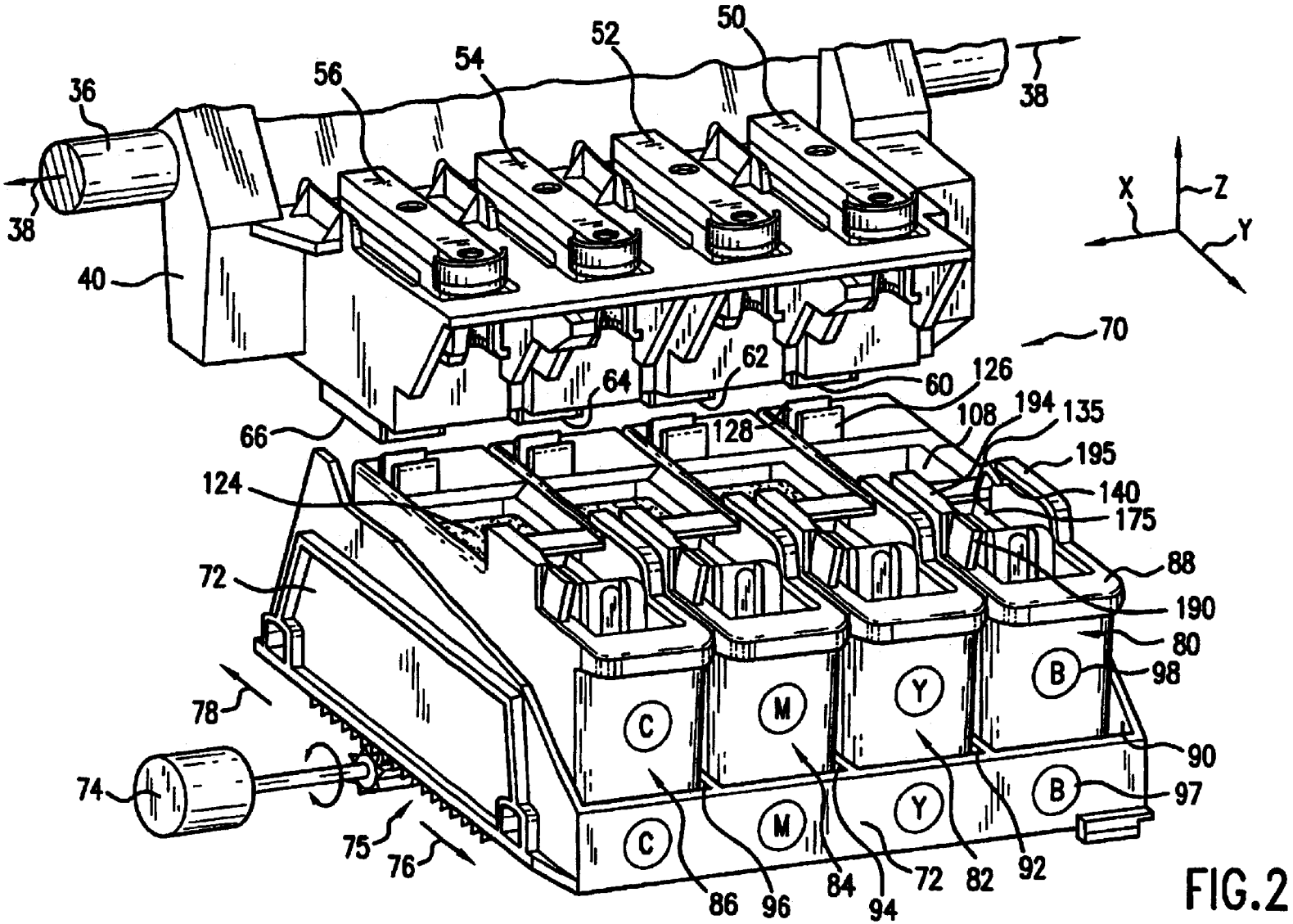
FIG. 2 is an enlarged perspective view of the service station system of FIG. 1.

FIG. 2 shows the carriage 40 positioned with the pens 50–56 ready to be serviced by a replaceable printhead cleaner service station system 70, constructed in accordance with the present invention. The service station 70 includes a translationally moveable pallet 72, which is selectively driven by motor 74 through a rack and pinion gear assembly 75 in a forward direction 76 and in a rearward direction 78 in response to a drive signal received from the controller 30. The service station 70 includes four replaceable inkjet printhead cleaner units 80, 82, 84 and 86, constructed in accordance with the present invention for servicing the respective printheads 50, 52, 54, and 56. Each of the cleaner units 80–86 includes an installation and removal handle 88, which may be gripped by an operator when installing the cleaner units 80-86 in their respective chambers or stalls 90,92,94, and 96 defined by the service station pallet 72. Following removal, the cleaner units 80–86 are typically disposed of and replaced with a fresh unit, so the units 80–86 may also be referred to as "disposable cleaner units." To aid an operator in installing the correct cleaner unit 80–86 in the associated stall 90–96, the pallet 72 may include indicia, such as a "B" marking 97 corresponding to the black pen 50, with the black printhead cleaner unit 80 including other indicia, such as a "B" marking 98, which may be matched with marking 97 by an operator to assure proper installation.

Each of the cleaner units 80–86 also includes a spittoon chamber 108 for receipt of spitted ink. For the color cleaner units 82–86 the spittoon 108 may be filled with an ink absorber 124, preferably of a foam material, although a variety of other absorbing materials may also be used. The absorber 124 receives ink spit from the color printheads 62–66, and holds this ink while the volatiles or liquid components evaporate, leaving the solid components of the ink trapped within the chambers of the foam material. The spittoon 108 of the black cleaner unit 80 may be supplied as an empty chamber, which then fills with the tar-like black ink residue over the life of the cleaner unit.

Each of the cleaner units 80–86 includes a dual bladed wiper assembly which has two wiper blades 126 and 128, which are preferably constructed with rounded exterior wiping edges, and an angular interior wiping edge, as described in the Hewlett-Packard Company's U.S. Pat. No. 5,614,930. Preferably, each of the wiper blades 126, 128 is constructed of a flexible, resilient, non-abrasive, elastomeric material, such as nitrile rubber, or more preferably, ethylene polypropylene diene monomer (EPDM), or other comparable materials known in the art. For the wipers blades 126 and 128, a suitable durometer, that is, the relative hardness of the elastomer, may be selected from the range of 35–80 on the Shore A scale, or more preferably within the range of 60–80, or even more preferably at a durometer of 70+/−5, which is a standard manufacturing tolerance.

For assembling the black cleaner unit 80, which is used to service the pigment based ink within the black pen 50, an ink solvent chamber (not shown) receives an ink solvent, which is held within a porous solvent reservoir body or block installed within the solvent chamber. Preferably, the reservoir block is made of a porous material, for instance, an open-cell thermoset plastic such as a polyurethane foam, a sintered polyethylene, or other functionally similar materials known to those skilled in the art. The inkjet ink solvent is preferably a hygroscopic material that absorbs water out of the air, because water is a good solvent for the illustrated inks. Suitable hygroscopic solvent materials include polyethylene glycol ("PEG"), lipponic-ethylene glycol ("LEG"), diethylene glycol ("DEG"), glycerin or other materials known to those skilled in the art as having similar properties. These hygroscopic materials are liquid or gelatinous compounds that will not readily dry out during extended periods of time because they have an almost zero vapor pressure. For the purposes of illustration, the reservoir block is soaked with the preferred ink solvent, PEG.

To deliver the solvent from the reservoir, the black cleaner unit 80 includes a solvent applicator or member 135, which underlies the reservoir block.

Each of the cleaner units 80–86 also includes a cap retainer member 175 which can move in the Z axis direction, while also being able to tilt between the X and Y axes, which aids in sealing the printheads 60–66. The retainer 175 has an upper surface which may define a series of channels or troughs, to act as a vent path to prevent depriming of the printheads 60–66 upon sealing, for instance as described in U.S. Pat. No. 5,867,184, currently assigned to the present assignee, the Hewlett-Packard Company.

Each of the cleaner units 80–86 also includes a snout wiper 190 for cleaning a rearwardly facing vertical wall portion of the printheads 60–66, which leads up to an electrical interconnect portion of the pens 50–56. The snout wiper 190 includes a base portion which is received within a snout wiper mounting groove 194 defined by the unit cover. While the snout wiper 190 may have combined rounded and angular wiping edges as described above for wiper blades 126 and 128, blunt rectangular wiping edges are preferred since there is typically no need for the snout wiper to extract ink from the nozzles. The unit cover also includes a solvent applicator hood 195, which shields an extreme end 140 of the solvent applicator 135 and a portion of the retainer member 175 when assembled.

Figure 3:
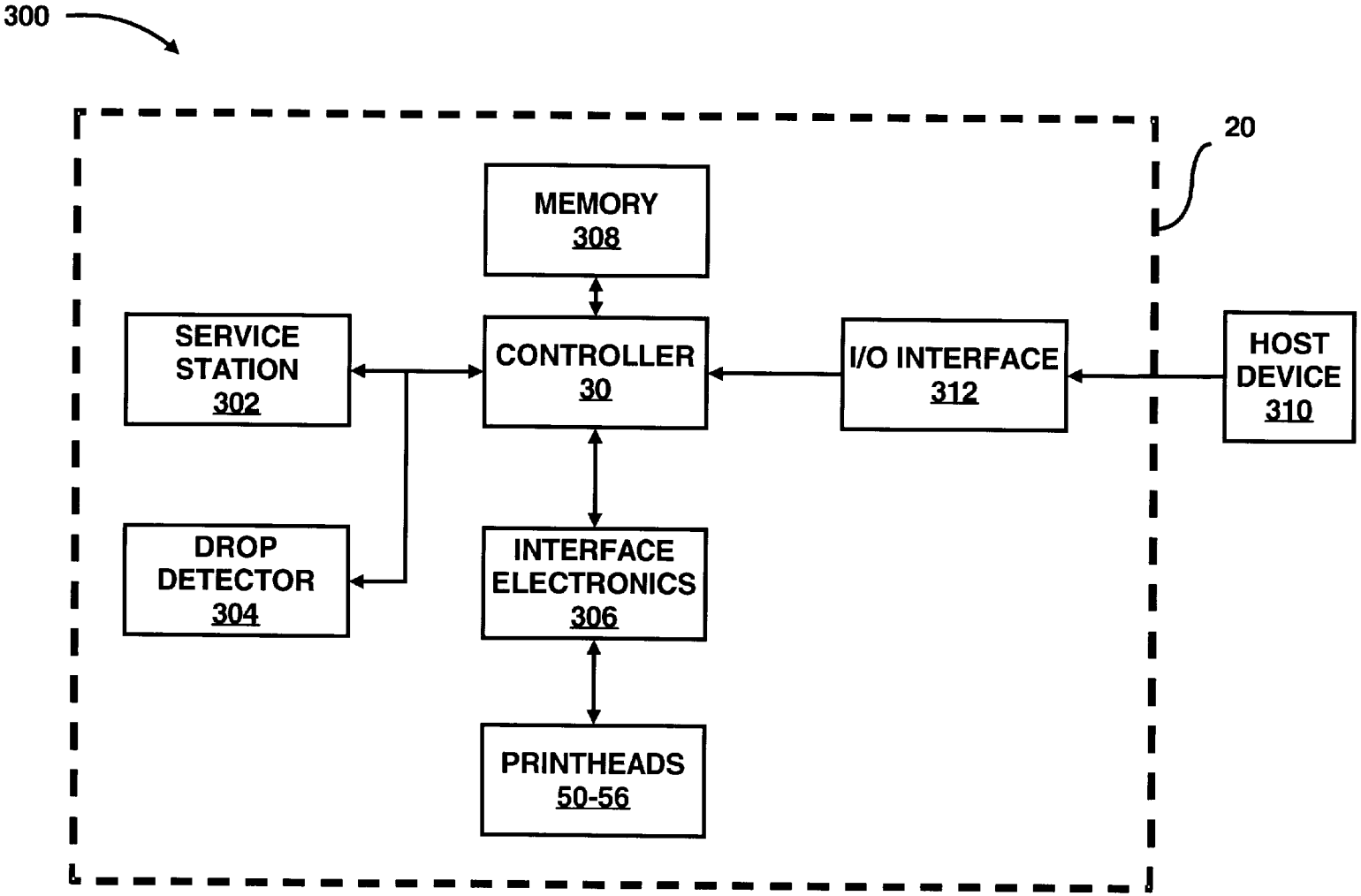
FIG. 3 is an exemplary block diagram of a printing mechanism in accordance with an embodiment of the present invention.

Referring to FIG. 3, there is illustrated an exemplary block diagram 300 of a printer 20 in accordance with the principles of the present invention. The following description of the block diagram 300 illustrates one manner in which a printer 20 having a service station 302 and a drop detector 304 may be operated in accordance with the principles of the present invention. In this respect, it is to be understood that the following description of the block diagram 300 is but one manner of a variety of different manners in which such a printer may be operated.

Generally speaking, the printer 20 includes a plurality of printheads 50–56. As stated hereinabove, the printer 20 may include any reasonably suitable number of printheads. Therefore, the illustration and description of four printheads 50–56 are for purposes of simplicity and are not meant as limitations. The printer 20 is illustrated in terms of a large format inkjet printer; however, it should be understood and readily apparent to those skilled in the art that the focused drop detection disclosed herein may be implemented in any reasonably suitable type of printer without departing from the scope or spirit of the present invention.

The printer 20 may include interface electronics 306. The interface electronics 306 may be configured to provide an interface between the controller 30 of the printer 20 and the components for moving the printheads 50–56, e.g., a carriage, belt and pulley system (not shown), etc. The interface electronics 306 may include, for example, circuits for moving the printheads 50–56, moving the medium, firing individual nozzles of the printheads, and the like.

The controller 30 may be configured to provide control logic for the printer 20, which provides the functionality for the printer. In this respect, the controller 30 may be implemented by the microprocessor as mentioned above as well as, a micro-controller, an application specific integrated circuit, and the like. The controller 30 may be interfaced with a memory 308 configured to provide storage of a computer software that provides the functionality of the printer 20 and may be executed by the controller. The memory 308 may also be configured to provide a temporary storage area for data/file received by the printer 20 from a host device 310, such as a computer, server, workstation, and the like. The memory 308 may be implemented as a combination of volatile and non-volatile memory, such as dynamic random access memory ("RAM"), EEPROM, flash memory, and the like. It is also within the purview of the present invention that the memory 308 may be included in the host device 310.

The controller 30 may further be interfaced with an 110 interface 312 configured to provide a communication channel between a host device 310 and the printer 20. The I/O interface 312 may conform to protocols such as RS-232, parallel, small computer system 30 interface, universal serial bus, etc. In addition, the controller 30 may be interfaced with the service station 302 and the drop detector 304. In this respect, the controller 30 may be configured to control the operations of the service station 302 (e.g., wiping, capping, and the like) as well as the drop detector 304 (e.g., when to perform the ink drop detections, which nozzles to perform the ink drop detections upon, and the like).

The drop detector 304 may comprise any reasonably suitable drop detector as is known to those skilled in the art. In this respect, the drop detector 304 may comprise any reasonably suitable commercially available drop detector. Examples of suitable drop detectors may include the optical drop detection device described in U.S. Pat. No. 6,238,112, the drop detector described in U.S. Pat. No. 6,086,190, and the piezoelectric membrane drop detector described in U.S. Pat. No. 4,835,435, all of which are currently assigned to the present assignee, the Hewlett-Packard Company. The disclosures contained in the above-cited patents are hereby incorporated by reference in their entireties.

During a drop detection operation, each operable nozzle in each of the printheads 50–56 is configured to release a sequence of ink droplets into the drop detector 304 in response to an instruction from the printer device 20. The drop detector 304 is configured to detect various characteristics of the released ink droplets. For example, the drop detector 304 may determine whether any ink drops were ejected during the drop detection operation. Those nozzles that have been determined as having failed to eject any ink drops may be replaced by other functioning nozzles during printing operations by application of print masks as is known to those of skill in the art. Other characteristics include the volume and the velocity of the ink drops ejected during the ink drop detection operation.

Depending upon the detected characteristics of the ink drops ejected by the nozzles, each of the nozzles may be categorized into one of a plurality of groups. For example, most drop detectors may be capable of determining the velocity of the ejected ink drop based upon the amount of time an ink drop took to trigger a sensing mechanism (e.g., a light beam in an optical detector, an electrostatic sensing element, and the like). In addition, an electrostatic drop detector may detect the volume of the ejected ink drop based upon the amount of electrical charge transferred to an electrostatic sensing element. Based upon the detected velocity and/or the volume of the ejected ink drop, the condition of the nozzle that fired the ink drop may be characterized.

A historical data of the detected characteristics may be created from prior drop detections. The historical data may be implemented to select which of the nozzles are more likely to produce printing defects and which are less likely to produce printing defects during future printing operations. In this respect, the historical data may be used on the basis that past performance of the nozzles are an indication of the future performance of the nozzles.

Figure 4B:
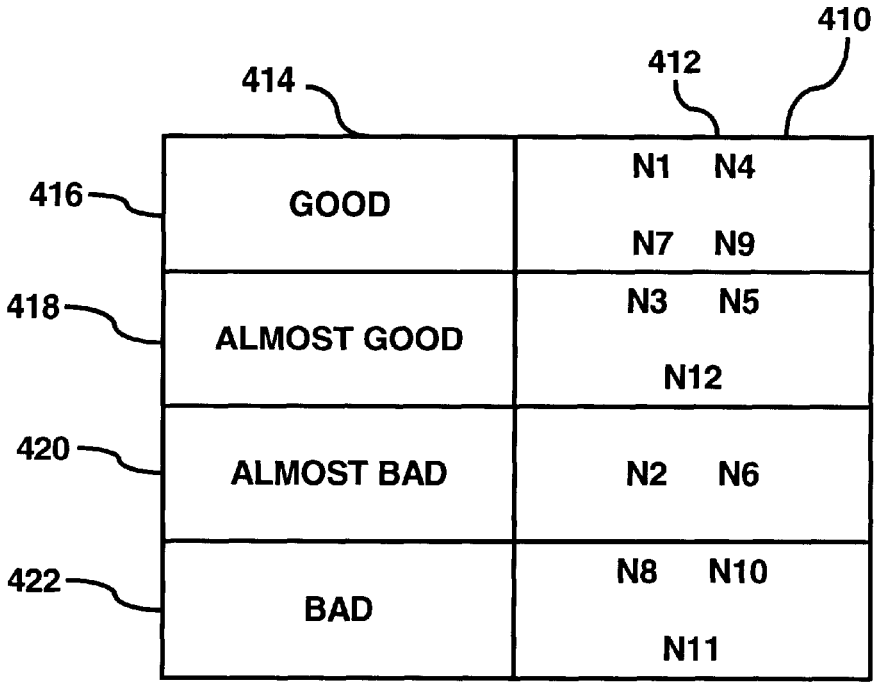
FIG. 4B is an exemplary chart in accordance with an embodiment of the present invention.
Figure 4A:
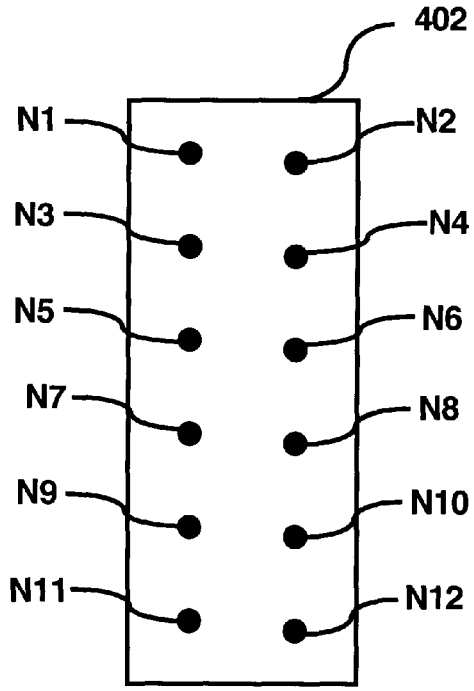
FIG. 4A is a bottom view of an exemplary printhead.

FIGS. 4A and 4B, together illustrate a manner in which the nozzles N1–N12 of an exemplary printhead 402 may be categorized. It should be understood that the printhead 402 illustrated in FIG. 4A is a simplified example of a printhead and therefore the number of nozzles depicted therein is for purposes of illustration only and is not meant to limit the invention in any manner. In FIG. 4B, a chart 410 may be created to depict the categorization of each of the nozzles N1–N12 according to their detected conditions. In this respect, exemplary chart 410 may include two columns 412 and 414 and four rows 416–422. Column 412 may contain the nozzle condition category and column 414 may contain the nozzles N1–N12. In addition, the rows 416–422 may contain the associations between the nozzle condition categories and the nozzles that fall within the selected nozzle condition categories. The number of condition categories and the manner in which the nozzles N1–N12 are categorized in FIG. 4A are not meant as limitations, rather, they are provided to illustrate one manner in which the present invention may be practiced.

The characterization of each of the nozzles may be stored in a memory device (e.g., a memory device of the drop detector 304, memory 308, in the host device 310, and the like). The characterization of the nozzles may be stored in the memory device in the form of the chart 410 and may be accessible by the controller 30 to determine which nozzles have been determined as requiring drop detection. The nozzles may be categorized into various groups that relate to their respective conditions. The number of groups into which the nozzles may be categorized may be predicated upon the level of distinction desired for the operation of the method according to the invention. In this respect, the number of groups are not limited to any described herein. Rather, the nozzles may be categorized into any reasonably suitable number of groups without deviating from the scope and spirit of the invention. Of course, the greater the number of groups available for distinguishing the conditions of the nozzles, the greater the accuracy in determining the timing and which nozzles are to be tested. For example, the nozzles may be categorized into three groups consisting of good, almost bad, and bad nozzles. As another example, the nozzles may be categorized into four groups consisting of good, almost good, almost bad, and consistently bad or dead nozzles. For purposes of illustration, the invention will be described herein with reference to the above-described four groups. It should be understood that the use of four groups is not meant to limit the invention in any respect.

The nozzles may be characterized according to a deviation in their condition(s) from nominal operating conditions. For example, if a nozzle is operating at around 85–100% of its nominal operating condition(s), e.g., as set forth by the printhead manufacturer, printer manufacturer, through testing, etc., the nozzle may be characterized as being "good". As another example, if a nozzle is operating at around 70–85%, that nozzle may be characterized as "almost good". In addition, if a nozzle is operating at around 55–70%, that nozzle may be characterized as "almost bad" and if a nozzle is operation below around 55%, that nozzle may be characterized as "consistently bad" or "bad". The percentages enumerated above are for simplicity of description only and are therefore not meant to limit the invention in any respect. Instead, according to a preferred embodiment of the present invention, the condition categories may vary according to user preferences. In this respect, the condition categories may be predicated upon a selected printmode. For example, when a lesser quality printing operation is desired, e.g., draft printmode is selected, a nozzle may be characterized as "almost good" if it is determined to be operating at around 60–75%. Thus, a relatively lower threshold of operating condition may be set for lesser quality printing operations and a relatively higher threshold may be set for higher or better quality printing operations.

In accordance with another embodiment, the nozzles may be ranked according to their performance. In this respect, each of the nozzles may be allocated a score related to its performance. The relatively better performing nozzles may be given a relatively higher score, or a relatively lower score, depending on the manner of ranking. Nozzles falling within a predetermined range of scores may undergo a relatively greater number of drop detection operations than those nozzles falling outside the predetermined range. Those nozzles falling below the predetermined range of scores may be considered to have a relatively large probability of potential defects. In this respect, these nozzles may be omitted during future printing passes by operation of printing masks as is known to those skilled in the art.

In one respect, the level at which a nozzle performs may correlate to the probability of its expected future performance. That is, a nozzle that has historically performed above a predetermined level may be expected to continue to perform above the predetermined level during future printing passes. Whereas, a nozzle that has potential defects may be more closely monitored to determine when the potential defects reach a certain level. The above-described predetermined range of scores may be based upon a selected printmode and may thus correspond to a user's expectations. For example, if the selected printmode calls for a lower print quality, the predetermined range of scores may include nozzles that may have a higher probability of causing printing defects as compared to a higher print quality printmode. In this respect, when a lower quality printmode is selected, various defects in the printed output may be acceptable.

In addition, instead of testing all of the nozzles that fall within the predetermined range of scores, in order to further increase throughput, a sampling of those nozzles that fall within the predetermined range of scores may also be performed. For example, a certain percentage of those nozzles having scores that fall within the predetermined range of scores may be tested. Again, the percentage of nozzles to be tested may be predicated upon the selected printmode.

Moreover, operation of the above-described embodiment may be performed concurrently with drop detections performed on a sampling of nozzles having scores above the predetermined range of scores.

Figure 5:
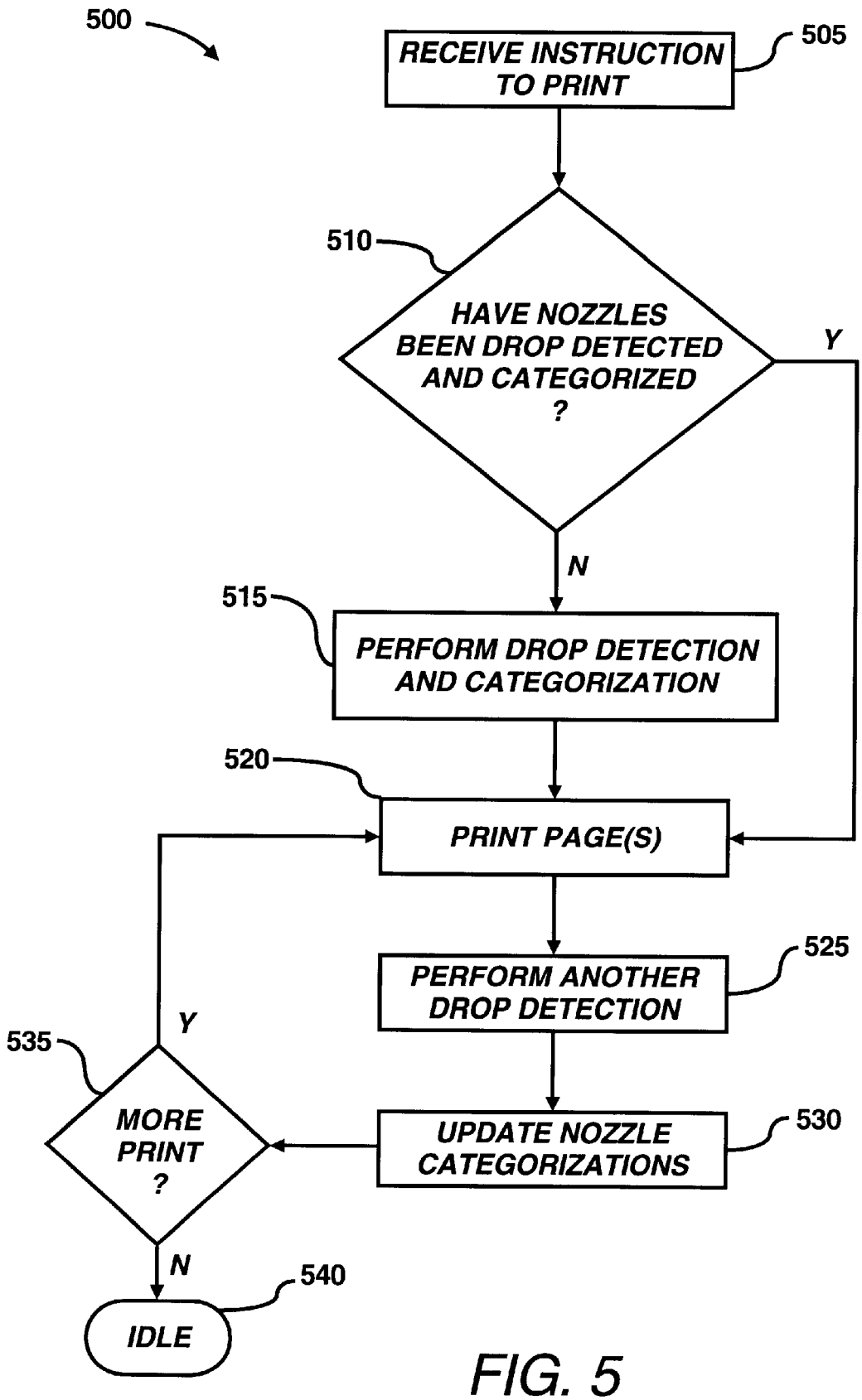
FIG. 5 is an exemplary flow diagram of a manner in which an embodiment of the present invention may be practiced.

Referring to FIG. 5, there is illustrated an exemplary flow diagram 500 of a manner in which the principles of the present invention may be practiced. It is to be understood that the steps illustrated in the flow diagram 500 may be be contained as a utility, program, subprogram, in any desired computer accessible medium. In addition, the flow diagram 400 may be embodied by a computer program, which can exist in a variety of forms both active and inactive. For example, they can exist as software program(s) comprised of program instructions in source code, object code, executable code or other formats. Any of the above can be embodied on a computer readable medium, which include storage devices and signals, in compressed or uncompressed form.

Exemplary computer readable storage devices include conventional computer system RAM (random access memory), ROM (read only memory), EPROM (erasable, programmable ROM), EEPROM (electrically erasable, programmable ROM), and magnetic or optical disks or tapes. Exemplary computer readable signals, whether modulated using a carrier or not, are signals that a computer system hosting or running the computer program can be configured to access, including signals downloaded through the Internet or other networks. Concrete examples of the foregoing include distribution of the programs on a CD ROM or via Internet download. In a sense, the Internet itself, as an abstract entity, is a computer readable medium. The same is true of computer networks in general. Although particular reference is made in the following description of FIG. 5 to the controller 30 as performing certain printer functions, it is to be understood that those functions may be performed by any electronic device capable of executing the above-described functions.

At step 505, the printer 20 may receive an instruction to print a plot, e.g., text, images, etc. The instruction to print the plot may be received from a variety of various sources. The sources my include, for example, the host device 310, the memory 308, the Internet, the printer 20 itself, etc. At step 510, a determination may be made of whether all of the nozzles have been drop detected and categorized. At step 515, if some of the nozzles have not been drop detected, and/or if some of the nozzles have not been categorized, a drop detection and/or categorization may be performed on all of the nozzles. If any of the nozzles has been previously characterized as "bad", e.g., nozzle-out, those nozzles may be withdrawn from the drop detection operation to thereby reduce the amount of time required to conduct the drop detection.

According to a preferred embodiment, a complete drop detection, e.g., drop detection of all of the nozzles, may be performed during an "into cap" routine. The "into cap" routine, as the name generally implies, refers to a drop detection and servicing routine that is performed substantially immediately after a printing operation has been performed and the printheads are capped in the service station. This is the preferred time to perform the complete drop detection on the nozzles, as well as the characterization of the nozzle conditions, because during this period, there are typically no immediately pending print jobs and thus no relatively adverse affects on throughput.

In addition to or in place of the performance of the complete drop detection during an "into cap" routine, the complete drop detection may be performed prior to performing a printing operation, e.g., the printing of the page. For example, even if the complete drop detection were performed during an "into cap" routine, it may be preferable to perform another complete drop detection prior to starting the printing of the page if the nozzles have been capped for a predetermined amount of time. Moreover, various other factors may also apply in the determination to perform the complete drop detection prior to printing the page. Examples of these factors include, the potential for the nozzles to dry out in cap, insufficient cleaning of the nozzles prior to going "into cap", improper capping of the nozzles, to name but a few.

At step 520, after the nozzles have been drop detected, categorized an a historical representation of the nozzles have been created, e.g., in the manner described hereinabove with respect to FIGS. 4A and 4B, the printing job may begin. Some time after the printing job has begun, e.g., after the printing of one or more printing pages, after the printing of a plurality of passes, etc., another drop detection may be performed at step 525. The time in which the another drop detection is performed may be predicated upon a servicing subroutine or it may be a function of the selected printmode. For example, if a lesser quality printing operation is selected, e.g., draft printmode, the another drop detection may not occur until sometime after the printing operation is initiated, e.g., after the printing of a second or third page. In comparison, for example, if a better quality printing operation is selected, the another drop detection may occur after a single printing pass. In this respect, the timing of the drop detection operations as well as its frequency of occurrence, may be set forth by a user.

In performing the another drop detection at step 525, the nozzles that undergo drop detection may vary according to the selected printmode. In this respect, if a relatively lesser quality printing operation, e.g., draft printmode, is selected, those nozzles categorized under a predetermined condition category as well as those that fall below that category may be tested. For example, with reference to FIG. 4B, in the draft printmode, those nozzles in the "Almost Bad" category may be tested, i.e., nozzles N2 and N6. As another example, again with reference to FIG. 4B, if a higher quality printmode were selected, those nozzles N3, N5, and N12 in the "Almost Good" category and those nozzles N2 and N6 in the "Almost Bad" category may be tested. In any instance, those nozzles in the "Bad" category, i.e., and N8, N10, and N11, would not be tested because they have already been determined to be defective. It is possible, however, that the nozzles N8, N10, and N11 may be switched to another category if they are able to be recovered, e.g., undergo a successful recovery operation in a manner known to those skilled in the art.

In accordance with a preferred embodiment of the present invention, a sampling portion of those nozzles that fall within the selected category are drop detected at step 525. The sampling portion of these nozzles may be predicated upon the selected printmode. For example, if the selected category of nozzles comprises 50% of all of the nozzles in a printhead, for a selected lower quality printing operation, the sampling portion may comprise 50% of the nozzles in the selected category of nozzles. Whereas, for example, for a selected higher quality printing operation, the sampling portion may comprise 75% of the nozzles in the selected category of nozzles. Operation of this preferred embodiment functions to further decrease the amount of time necessary to perform the drop detection avails the user with greater flexibility in selecting desired throuput and print quality.

According to another preferred embodiment of the present invention, at least one nozzle in a category, preferably of a higher condition, in addition to those enumerated above may be tested in the another drop detection at step 525. The number of additional nozzles tested may be related to the selected printmode. In this respect, the higher or better the selected print quality, the greater the number of additional nozzles to be tested. For example, if the draft printmode were selected as described hereinabove, one nozzle from each of the "Good" and "Almost Good" categories may be tested along with those nozzles from the "Almost Bad" category. In addition, if a higher or better quality printmode were selected, more than one nozzle from the "Good" category may be tested along with those nozzles from the "Almost Good" and "Almost Bad" categories. The selection of the nozzles from the other categories may be based upon a predetermined subroutine that changes the nozzle tested during the performance of each another drop detection, or, the nozzles may be chosen in a random fashion.

At step 530, based upon the results of the another drop detection, the categorization of the nozzles may be updated. In this respect, those nozzles that did not undergo drop detection at step 525 may remain under the same category, whereas, the condition of those nozzles that have been detected may have either improved or deteriorated from a previous drop detection and their categorization may therefore be altered.

At step 535, it may be determined whether additional printing operations are required. If additional printing operations are required, then step 520 may be performed with step 525 being performed some time thereafter. The timing of the performance of step 525 may be determined in accordance with the description set forth hereinabove. If additional printing operations are not required, printer may enter an idle mode at step 540, e.g., stand-by, sleep, shut-down, etc. According to a preferred embodiment, prior to entering an idle mode, the printer may perform an "into cap" routine as described hereinabove. In performing the "into cap" routine, all of the categories of the nozzles may be updated for use in a subsequent printing operation.

The examples cited hereinabove are for illustrative purposes only and are thus not meant to limit the invention in any respect. In addition, the examples made reference to FIGS. 4A and 4B, which are substantially simplified versions of an actual printhead 402 and an exemplary chart 410. It is generally known to those of skill in the art that typical printheads may include over 1000 nozzles. Thus, application of the principles of the present invention in a printhead having over 1000 nozzles may yield relatively substantial savings in time and ink.

By virtue of the principles of the present invention, those nozzles that have not been previously determined as having a relatively high risk of failure are not tested. Instead, substantially only those nozzles that have been determined as having a relatively high risk of failure undergo a substantially major portion of the drop detection. In this respect, the number of nozzles that undergo drop detection during a printing operation may be substantially reduced. In so doing, the amount of time required to test the individual nozzles comprising a printhead may also be reduced thereby reducing the total time required to test a printhead. A decrease in the time required to test a printhead may also correspond to an increase in drop detection throughput which may increase the throughput of the printing operation. In addition, by substantially limiting performance of the drop detection operations on a reduced number of nozzles, the amount of ink utilized in performing the drop detection operations may be greatly reduced.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims—and their equivalents—in which all terms are meant in their broadest reasonable sense unless otherwise indicated.

What is claimed is:

1. A method of focused ink drop detection, said method comprising:

performing a first drop detection on a plurality of nozzles;

categorizing said plurality of nozzles into at least one group of nozzles of a plurality of groups of nozzles based upon the results of said first drop detection, each of said plurality of groups of nozzles corresponding to a predetermined nozzle condition;

storing said categorization of said plurality of nozzles in a memory; and performing a second drop detection on a first group of nozzles of said plurality of groups of nozzles, said first group of nozzles comprising less than all of said plurality of nozzles.

2. The method according to claim 1, further comprising:

categorizing said plurality of nozzles based upon at least one characteristic of an ink drop fired from said plurality of nozzles.

3. The method according to claim 2, further comprising:

detecting a velocity of an ink drop fired from said plurality of nozzles; and categorizing said plurality of nozzles based upon said detected velocity.

4. The method according to claim 2, further comprising:

detecting a volume of an ink drop fired from said plurality of nozzles; and categorizing said plurality of nozzles based upon said detected volume.

5. The method according to claim 1, further comprising:

characterizing said first group of nozzles as falling below a predetermined threshold condition.

6. The method according to claim 1, further comprising:

performing said second drop detection on at least one nozzle outside of said first group of nozzles.

7. The method according to claim 1, further comprising:

receiving a selected printmode; and setting conditions for selection of nozzles within said first group of nozzles in response to said selected printmode.

8. The method according to claim 7, wherein said setting conditions step includes:

setting a higher threshold condition in response to a selected lower quality printing operation;

setting a lower threshold condition in response to a selected higher quality printing operation.

9. The method according to claim 1, further comprising:

receiving a selected printmode; and setting conditions for determination of a number of nozzles falling outside of said first group of nozzles to detect in the performance of said second drop detection in response to said selected printmode.

10. The method according to claim 9, wherein said setting conditions step includes:

setting a higher number of nozzles to detect falling outside of said first group of nozzles in response to a selected higher quality printing operation;

setting a lower number of nozzles to detect falling outside of said first group of nozzles in response to a selected lower quality printing operation; and performing said second drop detection on said higher number of nozzles.

11. The method according to claim 1, wherein said step of performing said second drop detection comprises performing said second drop detection on a sampling of nozzles in said first group of nozzles.

12. The method according to claim 11, receiving a selected printmode; and setting conditions for determination of said sampling of nozzles in response to said selected printmode.

13. The method according to claim 1, wherein said nozzle condition of said first group of nozzles stand a substantially greater likelihood of creating printing defects.

14. The method according to claim 1, further comprising:

updating said categorization of said plurality of nozzles into at least one of said plurality of groups of nozzles, based upon the results of said second drop detection; and storing said updated categorization of said plurality of nozzles in said memory.

15. The method according to claim 14, further comprising:

performing another drop detection on another group of nozzles of said plurality of groups of nozzles based upon said updating step.

16. The method according to claim 1, further comprising:

performing another drop detection on substantially all of said plurality of nozzles in association with an into cap routine following a performance of a printing operation;

updating said categorization of said plurality of nozzles into at least one group of nozzles of said plurality of groups of nozzles based upon the results of said another drop detection; and storing said categorization of said plurality of nozzles in said memory.

17. The method according to claim 1, wherein said step of categorizing said plurality of nozzles comprises the step of assigning a score to said plurality of nozzles and wherein said step of performing said second drop detection comprises performing said second drop detection on a first group of nozzles of said plurality of groups of nozzles, said first group of nozzles having scores that fall within a predetermined range of scores.

18. The method according to claim 17, further comprising:

receiving a selected printmode; and setting said predetermined range of scores in response to said selected printmode.

19. The method according to claim 18, wherein said step of performing said second drop detection comprises performing said second drop detection on a percentage of said plurality of nozzles having scores falling within said predetermined range of scores, wherein said percentage of said plurality of nozzles corresponds to said selected printmode.

20. An apparatus for operating a printing mechanism having at least one printhead having a plurality of nozzles, said apparatus comprising:

a controller operable to control said plurality of nozzles to fire a set of ink drops into a drop detector;

said drop detector configured to determine a characteristic of said ink drops fired from said plurality of nozzles to thereby determine a condition of said plurality of nozzles;

a memory configured to store said conditions of said plurality of nozzles, wherein said plurality of nozzles are characterized and stored in terms of their conditions, and wherein said plurality of nozzles are grouped in terms of their conditions; and said controller being operable to control at least one group of nozzles of said plurality of nozzles to fire another set of ink drops into said drop detector, wherein said controller is operable to determine and control which group of said at least one group of nozzles to fire said another set of ink drops.

21. The apparatus according to claim 20, wherein said determination of which group of said at least one group of nozzles to fire said another set of ink drops is based upon a selected printmode.

22. The apparatus according to claim 20, wherein said controller is operable to determine and control at least one nozzle outside of said at least one group of nozzles to fire another set of ink drops into said drop detector.

23. The apparatus according to claim 22, wherein said determination of said at least one nozzle outside of said at least one group of nozzles is based upon a selected printmode.

24. The apparatus according to claim 20, wherein said controller is further operable to control said plurality of nozzles to fire a further set of ink drops into said drop detector in association with an into cap routine following a performance of a printing operation, wherein said controller is operable to update said conditions of said plurality of nozzles in response to said detection of said plurality of nozzles during said firing of said further set of ink drops into said drop detector, and wherein said memory is further configured to store said updated conditions of said plurality of nozzles.

25. A computer readable storage medium on which is embedded one or more computer programs, said one or more computer programs implementing a method for operating a printing mechanism having a printhead, said printhead having a plurality of nozzles, said one or more computer programs comprising a set of instructions for:

performing a first drop detection on said plurality of nozzles;

categorizing said plurality of nozzles into at least one group of nozzles of a plurality of groups of nozzles, based upon the results of said first drop detection, each of said plurality of groups of nozzles corresponding to a predetermined nozzle condition;

storing said categorization of said plurality of nozzles in a memory; and performing a second drop detection on a first group of nozzles of said plurality of groups of nozzles, said first group of nozzles comprising less than all of said plurality of nozzles.

26. The computer readable storage medium according to claim 25, said one or more computer programs further comprising a set of instructions for:

categorizing said plurality of nozzles based upon at least one characteristic of an ink drop fired from said plurality of nozzles.

27. The computer readable storage medium according to claim 25, said one or more computer programs further comprising a set of instructions for:

receiving a selected printmode;

setting conditions for selection of said first group of nozzles in response to said selected printmode, wherein said setting conditions step includes:

setting a higher threshold condition in response to a selected lower quality printing operation; and setting a lower threshold condition in response to a selected higher quality printing operation.

28. The computer readable storage medium according to claim 25, said one or more computer programs further comprising a set of instructions for:

receiving a selected printmode;

setting conditions for determination of a number of nozzles falling outside of said first group of nozzles to detect in the performance of said second drop detection in response to said selected printmode, wherein said setting conditions step includes:

setting a higher number of nozzles to detect falling outside of said first group of nozzles in response to a selected higher quality printing operation;

setting a lower number of nozzles to detect falling outside of said first group of nozzles in response to a selected lower quality printing operation; and performing said second drop detection on nozzles falling outside of said first group.

29. The computer readable storage medium according to claim 25, said one or more computer programs further comprising a set of instructions for:

updating said categorization of plurality of nozzles into at least one of said plurality of groups based upon the results of said second drop detection; and storing said updated categorization of said plurality nozzles in said memory.

30. The computer readable storage medium according to claim 25, said one or more computer programs further comprising a set of instructions for:

performing another drop detection on substantially all of said plurality of nozzles in association with an into cap routine following a performance of a printing operation;

updating said categorization of said plurality of nozzles into at least one group of said plurality of groups based upon the results of said another drop detection; and storing said categorization of said plurality of nozzles in said memory.

* * * * *